US008343311B2

(12) United States Patent
Hund et al.

(10) Patent No.: US 8,343,311 B2
(45) Date of Patent: Jan. 1, 2013

(54) METHOD FOR PRODUCING PAPER AND CARDBOARD

(75) Inventors: Rene Hund, Villars (FR); Gatien Faucher, Saint Etienne (FR)

(73) Assignee: S.P.C.M. SA, Andrezieux Boutheon (FR)

( * ) Notice: Subject to any disclaimer, the term of this patent is extended or adjusted under 35 U.S.C. 154(b) by 216 days.

(21) Appl. No.: 12/421,740

(22) Filed: Apr. 10, 2009

(65) Prior Publication Data

US 2009/0277597 A1 Nov. 12, 2009

Related U.S. Application Data

(60) Provisional application No. 61/123,611, filed on Apr. 10, 2008, provisional application No. 61/074,222, filed on Jun. 20, 2008.

(30) Foreign Application Priority Data

Apr. 10, 2008 (FR) ..... 08 52415
May 19, 2008 (FR) ..... 08 53245

(51) Int. Cl.

| | |
|---|---|
| ***D21H 17/28*** | (2006.01) |
| ***D21H 17/32*** | (2006.01) |
| ***D21H 17/34*** | (2006.01) |
| ***D21H 17/45*** | (2006.01) |
| ***D21H 17/63*** | (2006.01) |
| ***D21H 17/68*** | (2006.01) |
| ***D21H 21/10*** | (2006.01) |

(52) U.S. Cl. ..... 162/168.3; 162/158; 162/164.6; 162/178; 162/181.1; 162/181.6; 162/181.8; 162/185; 526/72; 526/286; 526/303.1; 526/307.3; 526/312; 526/319

(58) Field of Classification Search ..... 162/158, 162/164.3, 164.5, 164.6, 175, 178, 181.1, 162/185, 181.6, 181.8, 168.3, 181, 1; 526/72, 526/286, 303.1, 307.2, 307.3, 312, 319
See application file for complete search history.

(56) References Cited

U.S. PATENT DOCUMENTS

| | | | | |
|---|---|---|---|---|
| 4,528,321 | A * | 7/1985 | Allen et al. | 524/761 |
| 4,968,435 | A * | 11/1990 | Neff et al. | 210/734 |
| 5,152,903 | A * | 10/1992 | Neff et al. | 210/734 |
| 5,167,766 | A * | 12/1992 | Honig et al. | 162/164.1 |
| 5,239,014 | A * | 8/1993 | Takaki et al. | 525/328.4 |
| 5,274,055 | A * | 12/1993 | Honig et al. | 524/47 |
| 5,340,865 | A * | 8/1994 | Neff et al. | 524/317 |
| 5,501,774 | A * | 3/1996 | Burke | 162/164.1 |
| 6,103,065 | A * | 8/2000 | Humphreys et al. | 162/181.8 |
| 6,524,439 | B2 * | 2/2003 | Chen et al. | 162/168.1 |
| 7,070,696 | B2 * | 7/2006 | Weir et al. | 210/727 |
| 2004/0058006 | A1 * | 3/2004 | Barry et al. | 424/489 |
| 2005/0150622 | A1 * | 7/2005 | Hund et al. | 162/181.8 |
| 2005/0239957 | A1 * | 10/2005 | Pillsbury et al. | 524/801 |
| 2006/0084772 | A1 * | 4/2006 | Wong Shing et al. | 526/217 |
| 2006/0130991 | A1 * | 6/2006 | Solhage et al. | 162/158 |

FOREIGN PATENT DOCUMENTS

| | | | |
|---|---|---|---|
| EP | 202780 | A2 * | 4/1986 |
| WO | WO 2009/136024 | A2 * | 11/2009 |

OTHER PUBLICATIONS

"Montmorillonite/Smectite" technical data sheet, Reade Advanced Materials, 2006, [online], [retrieved on Aug. 24, 2006]. Retrieved from the Internet: <URL: http://www.Reade.com/Products/Minerals_and_Ores/smectite.html>.*

Definition of "issue", The Free Dictionary by Farlex, no date [online] [retrieved on Oct. 27, 2011] 2 pages, Retrieved from the Internet: <URL: http://www.thefreedictionary.com/issue>.*

"Microemulsiion Polymerization" Encyclopedia of Polymer Science and Technology, vol. 7., John Wiley and Sons, 2003, [online], pp. 120-131 [retrieved on Mar. 24, 2012]. Retrieved from the Internet: <URL: http://onlinelibrary.wiley.com/doi/10.1002/0471440264.pst458.pdf>.*

"standard",definitiion by the Free Online Dictionary, Thesaurus and Encyclopedia, [online], 4 pages [retrieved on Mar. 24, 2012]. Retrieved from the Internet: <URL: http://www.thefreedictionary.com/standard>.*

"Microemulsion Polymerization", Encyclopedia of Polymer Science and Technology John Wiley & Sons, Inc., Published Online: 2003, pp. 120-131, [retrieved on Oct. 20, 2012]. Retrieved from the Internet:< URL: http://onlinelibrary.wiley.com/doi/10.1002/0471440264.pst458/pdf>.*

* cited by examiner

*Primary Examiner* — Matthew Daniels
*Assistant Examiner* — Dennis Cordray
(74) *Attorney, Agent, or Firm* — Heslin Rothenberg Farley & Mesiti P.C.

(57) ABSTRACT

A method for producing paper, cardboard or similar materials, comprising, separately or in a mixture, adding to a fibrous suspension: at least one main retention agent comprising a cationic (co)polymer, and at least one dual retention agent comprising a crosslinked cationic (co)polymer obtained in the form of a dispersion and placed in solution prior to its introduction into the fibrous suspension with gentle stirring. The crosslinked cationic (co)polymer having—a UL viscosity of between 1.3 and 2.7 cps, preferably between 1.5 and 2.4 cps, and—an apparent cationicity ratio of between 25 and 75%. Optionally, before or after the dual agent or the main retention agent are added, one or more tertiary retention agent(s) selected from the group comprising mineral particles and organic polymers carrying anionic charges, is added to the suspension.

19 Claims, No Drawings

METHOD FOR PRODUCING PAPER AND CARDBOARD

CROSS REFERENCE TO RELATED APPLICATIONS

This application claims priority of U.S. provisional patent application No. 61/123,611 filed on Apr. 10, 2008, U.S. provisional patent application No. 61/074,222 filed on Jun. 20, 2008, French application No. 0852415 filed on Apr. 10, 2008, and French application No.: 0853245, filed on May 19, 2008, the entire disclosure of these applications being hereby incorporated herein by reference.

BACKGROUND ART

The invention relates to a method for producing paper, cardboard or similar materials, using at least two retention and drainage agents, each one organic and having an overall cationic charge, respectively a main agent and a dual retention agent, also designated a secondary retention agent. It also relates to the papers or cardboards obtained by this method. It further relates to the use of specific crosslinked cationic organic (co)polymers, as dual retention agents.

Retention and drainage systems are well known in the papermaking process. They have the function of improving the retention of the cellulose fibers and mineral fillers during the preparation of the sheet. Numerous publications are available on this subject, and also a number of products and processes used in the industry. This is therefore a technical sector that has been the subject of numerous investigations, in which certain parameters are well known, while other parameters are less well known.

The prior art contains:

- Patent EP-A-235893, which describes the addition of a high molecular weight cationic polymer (main retention agent), followed by a shear step, followed by the addition of bentonite (secondary retention agent). According to this patent, the polymer must be essentially linear (without deliberate addition of branching agent).
- Methods using a mineral particle of the colloidal silica type (including EP 348366) which thus describe the optional addition of a coagulating agent to the pulp slurry, followed by a cationic polymer, followed by a polysilicic acid, obtained by chemical reaction of sodium silicate with sulfuric acid (colloidal silica), itself characterized by a very high specific surface area of at least 1050 $m^2/g$.
- Patent EP 462365 relates to the use of a polymer (main retention agent) in a "dual" type retention system, followed by an organic microparticle (secondary retention agent), both obtained by microemulsion polymerization.
  - U.S. Pat. No. 5,180,473, also relative to the use of a "dual" type system of a polymer (main retention agent) followed by an organic microparticle (secondary retention agent) which states (col.3, 1.65) that the microparticles must have the most uniform possible and the finest possible size.
  - The Hund patent (EP 1086276) which proposes the use of a crosslinked cationic polymer combined with a bentonite in a dual retention system and is characterized in that the crosslinked polymer needs to be highly sheared (about 10,000 rpm) at a high concentration before the introduction or injection into the suspension to be flocculated.

In the context of the present invention, by the term "dispersion" or similar terms relating to the polymer used according to the invention, a person skilled in the art will understand that it means an organic particle obtained by polymerization and having the form:

- either of a conventional reverse emulsion of the water-in-oil type, that is a composition comprising a continuous oily phase, a discontinuous aqueous phase, and at least one emulsifier,
- or a "water-in-water" emulsion, that is a composition comprising a continuous aqueous phase in which the polymer is in suspension.

Contrary to the dispersions of the invention, the organic microparticles in the form of a microemulsion of the water-in-oil type of the prior art are characterized in that for emulsification, they require a large quantity of surfactants having a high HLB and are distinguished by the fact that, contrary to the "standard" dispersions of the invention, they are:

- thermodynamically stable,
- translucent,
- and the size of the dispersed particles is much smaller than one micron, generally about 0.1 to 0.3 micron.

It may be observed that, as is the case for the retention systems using mineral microparticles, a person skilled in the art knows that the size of the organic crosslinked particles is a direct indication of their particulate aggregation power (i.e. retention), and hence of the effectiveness of the particle. This is explained in particular by the fact that a decrease in the particle size serves to increase the availability of the charged anionic or cationic sites, which can then contribute in large numbers to the flocculation of the fibers.

BRIEF SUMMARY OF INVENTION

The invention therefore relates to a method for producing paper, cardboard or similar materials, which consists, separately or in a mixture, in adding to the fibrous suspension:

- at least one main retention agent consisting of a cationic (co)polymer,
- and at least one dual retention agent consisting of a crosslinked cationic (co)polymer obtained in the form of a dispersion and placed in solution prior to its introduction into the fibrous suspension with gentle stirring, said crosslinked cationic (co)polymer having—a UL viscosity of between 1.3 and 2.7 cps, preferably between 1.5 and 2.4 cps, and—an apparent cationicity ratio of between 25 and 75%,
- and, optionally, before or after the dual agent or main retention agent, one or more tertiary retention agents selected from the group comprising mineral particles and organic polymers carrying anionic charges.

DETAILED DESCRIPTION

In the rest of the description and in the claims, the expression "gentle stirring" means stirring that does not cause any significant change in the structure of the dual retention agent, before its addition to the fibrous suspension. In practice, the stirring is at the rate of about 50 to 500 rpm, preferably 70 to 200 rpm.

The term "cationicity" means the density of the positive charges carried by a compound.

In one advantageous embodiment, the dual retention agent has a cationicity lower than 4 meq/g.

The method of the invention serves to obtain a significantly improved retention, and without a negative effect. As another additional feature of this improvement, the drainage properties are also improved, while preserving the quality of formation of the sheet.

From a reading of the prior art, a person skilled in the art knew that to be effective, a retention system of the dual or microparticulate type nearly universally required the combination of two retention agents having opposite charges (in general a cationic polymer+bentonite, silica or anionic organic polymer) and not 2 cationic retention agents, as in the case of the invention. Mention can be made in particular of the main retention systems used by the paper industry, such as FLOBIND (SNF), HYDROCOL (Ciba), POLYFLEX (Cytec), COMPOSIL (Eka), PARTICOL (Dupont), POSITEK (Nalco), etc.

Furthermore, even if the use of crosslinked cationic polymers as retention agent were known in the prior art, a person skilled in the art knew the conditions different from those of the invention for the use of crosslinked cationic polymers as retention agents, that is:

- a very high shear (about 10,000 rpm) at the time of placing in solution (EP 1086276) in the context of paper,
- or a very low UL viscosity, lower than 1.3 cps, and a very high crosslinking as in U.S. Pat. No. 5,180,473.

Based on this knowledge which appears to be damning, the risk of failure was therefore high. This explains the fact that the technology of the invention, with the aim of using, in a dual system, two retention and drainage agents, each of them organic, having the same overall cationic charge, and of which one is crosslinked and obtained in a dispersion (standard reverse emulsion or aqueous dispersion) has not been employed.

As already stated, the invention relates to an improved method which consists in adding, to the suspension or fibrous mass or pulp slurry to be flocculated, as main retention agent, at least one cationic (co)polymer followed by the addition, in a mixture or not, of at least one crosslinked cationic organic dual retention agent, obtained in a dispersion and having—a UL viscosity of between 1.3 and 2.7 cps, preferably between 1.5 and 2.4 cps, and—an apparent cationicity ratio of between 25 and 75%.

This selection of a crosslinked cationic organic (co)polymer, having a low UL viscosity, having a specific apparent cationicity ratio and only requiring a low shear (about 50 to 500 rpm, preferably 70 to 200 rpm) at the time of its placement in solution at a concentration, in practice of between 2 and 10 g/l before introduction (contrary to patent EP 1086276) serves to obtain an unprecedented level of performance in papermaking applications for total retention, retention of fillers, and for drainage.

The additions of the main retention agent and the dual agent are separated or not by a shear step, for example, at the pressure screen. Reference can be made in this context to the specification of U.S. Pat. No. 4,753,710 and to a vast prior art dealing with the point of addition of the retention agent with regard to the existing shear steps on the machine, in particular U.S. Pat. No. 3,052,595, Unbehend, TAPPI Vol. 59, No. 10, October 1976, Luner, 1984 Papermakers Conference or Tappi, April 1984, pp 95-99, Sharpe, Merck and Co Inc, Rahway, N.J., USA, around 1980, Chapter 5 "Polyelectrolyte Retention Aids", Britt, Tappi Vol. 56, October 1973, p 46 ff. and Waech, Tappi, March 1983, pp 137, or even U.S. Pat. No. 4,388,150.

The method of the invention can have several embodiments.

In a first embodiment, the retention drainage system used during the method for producing paper, cardboard or similar materials, respectively comprises a main retention agent and a dual retention agent, each one organic and having an overall cationic charge as defined according to the invention. According to this embodiment, preferably, the main retention agent is introduced after the fan pump and before the pressure screen, and the dual retention agent is injected after the pressure screen, the last high shear point before the headbox.

In a second embodiment, as in the previous one, the two cationic organic retention agents according to the invention are added to the suspension, and also a tertiary retention agent selected from retention agents having an overall anionic charge well known to a person skilled in the art. In this case, the order of the addition points of the dual retention agent, the main retention agent and the tertiary retention agent may be reversed, but preferably, however, the dual agent is introduced after the pressure screen and before the tertiary agent.

In a third embodiment, the two cationic organic retention agents according to the invention are added to the suspension in the form of a mixture, at a single or a plurality of addition points, in combination or not with a tertiary retention agent, before or after the pressure screen.

A. The Main Retention and Drainage Agent: the Cationic (Co)Polymer

The main retention agent is characterized in that it is a cationic (co)polymer:

- of at least one nonionic monomer selected from the group comprising acrylamide and/or methacrylamide and/or one of their substituted derivatives (such as N-isopropylacrylamide or N—N-dimethylacrylamide) and/or N-vinylformamide and/or N-vinyl acetamide and/or N-vinylpyrrolidone, advantageously the acrylamide,
- and, preferably at least one unsaturated cationic ethylenic monomer, selected from the group comprising the monomers of the type of dialkylaminoalkyl (meth)acrylate, dialkylaminoalkyl (meth)acrylamide, diallylamine, methyldiallylamine and their quaternary ammonium or acidic salts. Mention can be made in particular of dimethylaminoethyl acrylate (ADAME) and/or dimethylaminoethyl methacrylate (MADAME) quaternized or salified, dimethyldiallylammonium chloride (DADMAC), acrylamidopropyltrimethylammonium chloride (APTAC) and/or methacrylamidopropyltrimethylammonium chloride (MAPTAC).

It should be observed that all or part of the cationic charge of the main retention and drainage agent can also be obtained directly from the above-mentioned (co)polymers by means of degradation or hydrolysis reactions well known to a person skilled in the art. Mention can be made in particular of the Hofmann degradation or Hofmann reaction on an acrylamide (co)polymer, the hydrolysis reaction on a (co)polymer of N-vinylformamide and/or N-vinyl acetamide or the Mannich reaction on acrylamide based polymers. In a non-preferred manner, the main retention agent may also be a cationic polymer of natural origin such as, for example derivatives of starch or of guar gum, etc.

Optionally, the main retention agent may also be amphoteric by comprising, in combination with the cationic charges, anionic charges carried by anionic monomers, such as, for example, (meth)acrylic acid, acrylamidomethylpropane sulfonic acid, itaconic acid, maleic anhydride, maleic acid, vinylsulfonic acid, methallyl sulfonic acid and salts thereof.

This polymer does not require the development of a particular polymerization method. It can be obtained by all the polymerization techniques well known to a person skilled in the art: gel polymerization, precipitation polymerization, emulsion polymerization (aqueous or reverse) followed or not by a distillation step, suspension polymerization, solution polymerization, these polymerizations being followed or not by a step for isolating a dry form of the (co)polymer by all types of means well known to a person skilled in the art.

The main retention agent may also be branched or even crosslinked, preferably during (and/or optionally after) the polymerization, in the presence of a branching agent and optionally of a transfer agent. A nonlimiting list of the branching agents is given below: methylene bisacrylamide (MBA), ethylene glycol diacrylate, polyethylene glycol dimethacrylate, diacrylamide, cyanomethylacrylate, vinyloxyethylacrylate or methacrylate, triallylamine, formaldehyde, glyoxal, compounds of the glycidylether type such as ethyleneglycol diglycidylether, or epoxy resins or any other means well known to a person skilled in the art for chain branching.

Advantageously, the quantity of cationic (co)polymer introduced into the suspension to be flocculated is between thirty and one thousand grams of active polymer per tonne of dried pulp (30 and 1000 g/t), or between 0.003 percent and 0.1 percent. It has been observed that if the quantity is lower than 0.003%, no significant retention is obtained. Similarly, if this quantity exceeds 0.1%, no substantial improvement is observed. Preferably, the quantity of main retention agent introduced is between 0.015 and 0.05 percent (0.015 and 0.05%) of the quantity of dried pulp, or between 150 g/t and 500 g/t.

The injection or introduction of the main retention agent according to the invention is preferably carried out before a shear step, in practice advantageously before the pressure screen, in the dilute pulp slurry or "thin stock", that is, a pulp slurry diluted to about 0.5-1.5% of solid matter such as cellulose fibers, any fillers, and the various common papermaking additives.

B. The Dual Retention and Drainage Agent: the Crosslinked Cationic (Co)Polymer

In practice, the dual retention and drainage agent is a cationic organic polymer obtained by dispersion polymerization (water-in-water type emulsion or, preferably, standard reverse emulsion) by conventional polymerization methods. It is characterized in that:

it is crosslinked, it has a UL viscosity of between 1.3 and 2.7 cps, preferably 1.5 and 2.4 cps, it has an apparent cationicity ratio (ACR) of between 25 and 75%, it is placed in solution before introduction into the fibrous suspension with gentle stirring, of about 50 to 500 rpm, preferably 70 to 200 rpm and in practice 100 rpm.

The apparent cationicity ratio, which expresses as a percentage a measured cationicity compared to a theoretical cationicity, consists in comparing two cationicity values:

the apparent cationicity of the crosslinked (co)polymer (C1), then the real cationicity which consists of a determination of the counterion(s) of the cationic monomers (in general, these are chloride ions) (C2).

The apparent cationicity ratio is equal to: C1/C2*100.

This is directly related to the crosslinked character of the polymer: it is commensurately lower as the polymer is crosslinked, and commensurately higher as the polymer is closer to a linear structure.

More precisely, the dual retention agents are obtained by polymerization (or respectively copolymerization, both referred to in the description and the claims as "polymerization"), advantageously in a standard reverse emulsion, of at least one cationic monomer and optionally other nonionic monomers or, in a nonpreferred manner, anionic monomers, in the presence of a crosslinking agent. They must have an overall cationic charge.

A person skilled in the art, using his own knowledge or routine tests, can appreciate the polymerization conditions to be used to obtain a final polymer having a UL viscosity and an ACR as required.

Moreover, it is also possible to concentrate the polymer by all known techniques, such as for example azeotropic distillation and precipitation, spray drying, etc.

According to a preferred embodiment, the copolymer is obtained from:

5-100 mol % of at least one monomer having a cationic charge, advantageously 10-60 mol %, 0-95 mol % of at least one non-ionic and/or cationic monomer, advantageously 40-90 mol %, the polymerization concentration is preferably between 20 and 50%, and a crosslinking agent. Preferably, when the crosslinking agent is methylene bisacrylamide, the content of crosslinking agent must be higher than 2 ppm and lower than 75 ppm by weight of the total weight of the monomers, advantageously between 3 and 20 ppm. The quantity required can be easily determined by routine tests, by simply ensuring that the UL viscosity of the crosslinked cationic (co)polymer clearly corresponds to the specification of the invention, that is between 1.3 and 2.7 cps, preferably between 1.5 and 2.4 cps and by measuring the ACR.

A nonlimiting list of monomers which can be used is given below:

a) cationic monomers: mention can be made in particular and in a nonlimiting manner, of dimethylaminoethyl acrylate (ADAME) and/or dimethylaminoethyl methacrylate (MADAME) quaternized or salified, dimethyldiallylammonium chloride (DADMAC), acrylamidopropyltrimethylammonium chloride (APTAC) and/or methacrylamidopropyltrimethylammonium chloride (MAPTAC).

b) nonionic monomers: acrylamide, methacrylamide, N-isopropylacrylamide, N—N dimethylacrylamide, N-vinylformamide, N-vinyl acetamide, N-vinyl pyrrolidone, vinylacetate, acrylate esters, allyl alcohol, etc. and/or unsaturated anionic ethylenic monomers having a carboxylic function (e.g. acrylic acid, methacrylic acid, and salts thereof, etc.), having a sulfonic acid function (e.g. 2-acrylamido-2-methylpropane sulfonic acid (AMPS), methallyl sulfonic acid and salts thereof, etc.).

It is important to note that, in combination with these monomers, it is also possible to use monomers that are insoluble in water, such as acrylic, allyl, vinyl monomers comprising a hydrophobic group. During their use, these monomers are employed in very small quantities, lower than 20 mol %, preferably lower than 10 mol %, and they are preferably selected from the group comprising derivatives of acrylamide such as N-alkylacrylamide, for example N-tert-butylacrylamide, octylacrylamide and also N,N-dialkylacrylamides such as N,N-dihexylacrylamide, etc., derivatives of acrylic acid such as alkyl acrylates and methacrylates.

A nonlimiting list of crosslinking agents is given below: methylene bisacrylamide (MBA), ethylene glycol diacrylate, polyethylene glycol dimethacrylate, diacrylamide, cyanomethylacrylate, vinyloxyethylacrylate or methacrylate, triallylamine, formaldehyde, glyoxal, compounds of the glycidylether type such as ethyleneglycol diglycidylether, or epoxy resins and derivatives thereof or any other means well known to a person skilled in the art for crosslinking.

The dual retention agent is introduced into the suspension particularly preferably at the rate of 30 g/t to 1000 g/t by weight of active material (polymer) of the dry weight of the fibrous suspension, preferably 150 g/t to 500 g/t.

As stated above, the polymer can be used either in the form of a dispersion, dissolved or "reversed" in water, or in the form of a solution in water of the powder obtained from said dispersion.

The dual retention and drainage agents according to the invention, that is without high shear, are placed in solution industrially by simple stirring, using standard preparation (dissolution) units employing stirring of about 100 rpm, which represents a very low shear contrary to the preparation method required in the prior art for these polymers (e.g.: EP1086276).

C. Tertiary Retention Agent (Optional)

These anionic agents, well known to a person skilled in the art for their use as retention agents, preferably comprise, but without limitation, alone or in a mixture:

- anionic mineral particles such as derivatives of silica such as for example particles of silica including bentonites issuing from hectorites, smectites, montmorillonites, nontronites, saponites, sauconites, hormites, attapulgites and sepiolites, derivatives of the type of silicates, silicoaluminates or borosilicates, zeolites, kaolinites, colloidal silicas modified or not, or precipitated silica. This type of tertiary agent is preferably introduced just upstream of the headbox, at the rate of 0.01 to 0.5 percent (0.01 to 0.5%) by dry weight of the dry weight of the fibrous suspension,
- and organic polymers having an overall anionic charge and in all their forms, that is linear, branched or crosslinked.

In one advantageous embodiment, with or without tertiary agent, a coagulant is added to the fibrous suspension, prior to the addition of the main retention agent.

As a person skilled in the art well knows, the use of this type of product serves to commensurately improve the retention performance in contents (active) of 0.01 to 10 kg/t and preferably between 0.03 and 3 kg/t. Mention can be made in particular, and as examples, of the coagulants selected from the group comprising inorganic coagulants such as aluminum polychloride (PAC), aluminum sulfate, aluminum polychlorosulfate, etc., or organic coagulants including—polymers based on diallyldimethyl ammonium chloride (DADMAC), —polyethyleneimine, —quaternary polyamines produced by condensation of a primary or secondary amine on epichlorhydrin, polymers having functions of the vinylamine type or resins of the dicyandiamide type, etc. These coagulants can be used alone or in mixtures and are preferably added in a thick slurry or often in the white water.

The following examples illustrate the invention but without limiting its scope.

EXAMPLES

Measurement Methods a) The UL viscosity is measured using a Brookfield LVT type viscosimeter equipped with a UL adapter of which the spindle rotates at 60 rpm (0.1% by weight of polymer in a 1 M saline solution of sodium chloride).

b) The bulk viscosity is measured directly on the (co)polymer solution using a Brookfield viscosimeter equipped with an LVT type spindle and at 20° C.

c) The apparent cationicity ratio is defined by the ratio: ACR=C1/C2*100. The principle consists in determining the percentage apparent cationicity of a given polymer with regard to its theoretical cationicity. They are measured after precipitation of the polymer in acetone, in order to isolate the polymer from potential impurities.

In fact, depending on the structure of the (co)polymer (linear, branched, crosslinked), all the cationic sites are not necessarily accessible and therefore determinable by colloidal titration.

C1: Apparent Cationicity of the Crosslinked Cationic (Co) Polymer

The cationicity or cationic charge density (in meq/g) represents the quantity of "accessible" charges carried per 1 g of polymer. This property is measured by colloidal titration by an anionic polymer in the presence of a colored indicator sensitive to the anionicity of the polymer in excess.

In the context of a crosslinked polymer, only part of the charges can be and are determined, those buried in the polymer network being inaccessible to the titration agent.

In the examples below, the apparent cationicity was determined as follows. In a suitable container, 60 ml of 0.001 M-pH 6 sodium phosphate buffer solution and 1 ml of $4.1\times10^{-4}$ M o-toluidine blue solution are introduced, followed by 0.5 ml of cationic polymer solution to be determined. This solution is titrated with a potassium polyvinylsulfate solution to the indicator end point. The cationicity is obtained by the following equation:

$$\text{Cationicity(meq/g)}=(V_e pvsk*Npvsk)/(Vpc*Cpc)$$

Where:

Vpc is the volume of solution of cationic polymer;

Cpc is the concentration of cationic polymer in solution;

$V_e$pvsk is the volume of potassium polyvinylsulfate solution; and Npvsk is the normality of the potassium polyvinylsulfate solution.

C2: Theoretical (Total) Cationicity of the Crosslinked Cationic (Co)Polymer

The value of the theoretical cationicity reflects the cationicity actually present in the polymer. It is therefore unaffected by the structure of the polymer. It can be measured by conventional determination of the counterions of the cationic monomers. In the examples below, the theoretical cationicity is measured by simple determination of chloride ions (titration with silver nitrate).

Presentation of the Polymers

A) Main Retention Agent: the Cationic (Co)Polymer

In the examples below, the following polymers are used:

| Main retention agent | Type | Composition | Theoretical cationicity (meq/g) | Presence of crosslinking agent | Viscosity (in cps) |
|---|---|---|---|---|---|
| AP1 | Reverse emulsion | AM/ADC | 1.7 | NO | 4.6 (UL) |
| AP2 | Liquid | Hofmann product | 7.6 | NO | 30 cps (Bulk) |
| AP3 | Liquid | Luredur (BASF) | 7.9 | NO | 1400 cps (Bulk) |

Where:
AM: acrylamide
ADC: dimethylaminoethyl acrylate quaternized by methyl chloride B) Dual Retention Agent: the Crosslinked Cationic (Co)Polymer With the exception of AD4, prepared in an aqueous dispersion (water-in-water emulsion), all the organic polymers were prepared by the standard reverse emulsion polymerization technique according to the teachings of patent EP 202780.

| Polymer | Composition | Theoretical cationicity (meq/g) | Crosslinking agent (MBA) in wt % | UL Viscosity | % ACR |
|---|---|---|---|---|---|
| AD1 | AM/ADC | 2.8 | YES (5 ppm) | 2.3 | 42 |
| AD2 | AM/ADC | 2.8 | YES (2 ppm) | 2.7 | 45 |
| AD3 | AM/ADC | 2.8 | YES (20 ppm) | 1.5 | 39 |
| AD4 | AM/ADBZ | 2.8 | YES (5 ppm) | 2.2 | 42 |
| X1 | AM/ADC | 2.8 | YES (5 ppm) | 2.3 | 42 |
| X2 | AM/ADC | 2.8 | NO | 4.9 | 100 |
| X3 | AM/ADC | 2.8 | YES (100 ppm) | 1.2 | 25 |

ADBZ: dimethylaminoethyl acrylate quaternized by benzyl chloride
MBA: methylene bis acrylamide
Polymers denoted X correspond to check examples.

With the exception of X1 ((co)polymer obtained and sheared according to EP 1086276), the dual agents are prepared in the laboratory with simple magnetic stirring on a solution at a concentration of 5 g/l using a magnetized rod, that is with a low shear (comparable to a standard industrial unit for polymer dissolution).

C) Mixture of a Main Agent and a Dual Agent

| Retention agent | Type | Composition | Ratio | UL viscosity (cps) | % ACR |
|---|---|---|---|---|---|
| AP/AD | Reverse emulsion | AP1/AD1 | 50/50 | 3.5 | 66 |

D) Anionic Tertiary Agents

The anionic tertiary agents used in the different tests are:

| Tertiary agent | Type | Form | Name | Company |
|---|---|---|---|---|
| BI | Bentonite | Powder | Accoform BI | Amcol |
| NP780 | Silica | Liquid | NP780 | EKA |
| M100 | Organic | Emulsion | Telioform M100 | Ciba |

Test Procedure

The various tests were performed in a Britt Jar and with a pulp consisting of a mixture of short fibers (70%), long fibers (10%) mechanical pulp (20%), and 30% calcium carbonate added with regard to the total weight of the dry fibers.

The pulp slurry used was diluted to a consistency of 0.5%. 2.5 g of dry pulp was taken, corresponding to 500 g of 0.5% pulp. A volume of 500 ml of this diluted pulp was therefore introduced into the Britt Jar and the sequence begun.

Britt Jar sequence at 1000 rpm (revolutions per minute):

T=5s: Optional addition of coagulant

T=10s: Addition of component 1 (T1)

T=20s: Addition of component 2 (T2)

T=25s: Addition of component 3 (T3)

T=30s: Removal of the first 20 ml corresponding to the dead volume, then sampling of exactly 100 ml for filtration for the Britt Jar test.

The following analyses were then performed:

% FPAR: first pass ash retention in percentage

% FPR: first pass retention in percentage (total retention)

CSF: measurement of degree of drainability of the pulp (standard TAPPI T 227OM-94).

For each of these analyses, the highest values corresponded to the best performance.

Formation measurements: visual assessment (Frm Ind.). Scale of formation of sheets obtained: 1: excellent, uniform; 2: good, blended; 3: average, cloudy; 4: poor, frothy.

Presentation of Results

| No. | Cg | T1 | T2 | T3 | Respective determination (kg/t) | % FPAR | % FPR | CSF (ml) | Frm Ind. |
|---|---|---|---|---|---|---|---|---|---|
| | | White | | | — | 3.3 | 66.0 | 403 | 1 |
| 0 | | AP1 | | | 0.4 | 50.4 | 79.5 | 426 | 2 |
| 1 | | AP1 | BI | | 0.3/2 | 63.4 | 83.1 | 499 | 3 |
| 2 | | AD1 | BI | | 0.3/2 | 38.5 | 78.4 | 442 | 2 |
| 3 | | X1 | BI | | 0.3/2 | 62.7 | 82.9 | 493 | 3 |
| 4 | PAC | AP1 | NP780 | | 0.4/0.3/0.45 | 56.7 | 80.6 | 479 | 2 |
| 5 | PAC | AD1 | NP780 | | 0.4/0.3/0.45 | 36.4 | 77.5 | 444 | 2 |
| 6 | PAC | X1 | NP780 | | 0.4/0.3/0.45 | 54.5 | 80.1 | 477 | 2 |
| 7* | | AP1 | AD1 | | 0.2/0.2 | 67.9 | 85.6 | 516 | 2 |
| 8* | | AP1 | AD2 | | 0.2/0.2 | 61.7 | 82.3 | 495 | 2 |
| 9* | | AP1 | AD3 | | 0.2/0.2 | 58.7 | 81.9 | 491 | 2 |
| 10* | | AP1 | AD4 | | 0.2/0.2 | 67.5 | 85.4 | 515 | 2 |
| 11 | | AP1 | X1 | | 0.2/0.2 | 50.7 | 80.4 | 457 | 3 |
| 12 | | AP1 | X2 | | 0.2/0.2 | 51.9 | 80.6 | 442 | 4 |
| 13 | | AP1 | X3 | | 0.2/0.2 | 47.1 | 78.6 | 438 | 2 |
| 14 | | AP1 | M100 | | 0.2/0.2 | 57.9 | 81.7 | 436 | 3 |
| 15* | | AP2 | AD1 | | 0.2/0.2 | 61.9 | 82.5 | 493 | 2 |
| 16* | | AP3 | AD1 | | 0.2/0.2 | 62.1 | 82.6 | 499 | 2 |
| 17* | | AP/AD | AP/AD | | 0.2/0.2 | 60.3 | 84.8 | 495 | 2 |
| 18* | | AP/AD | | | 0.4 | 59.4 | 83.2 | 491 | 2 |
| 19* | | | AP/AD | | 0.4 | 63.1 | 85.6 | 513 | 3 |
| 20 | | AP1 | BI | | 0.2/2 | 48.6 | 78.0 | 479 | 3 |
| 21* | | AP1 | BI | AD1 | 0.2/2/0.2 | 74.3 | 88.6 | 610 | 2 |
| 22* | | AP1 | BI | AD2 | 0.2/2/0.2 | 70.8 | 86.4 | 603 | 2 |
| 23* | | AP1 | BI | AD3 | 0.2/2/0.2 | 69.2 | 85.9 | 599 | 2 |
| 24* | | AP1 | BI | AD4 | 0.2/2/0.2 | 73.8 | 88.3 | 607 | 2 |
| 25 | | AP1 | BI | X1 | 0.2/2/0.2 | 64.9 | 84.7 | 584 | 3 |
| 26 | | AP1 | BI | X2 | 0.2/2/0.2 | 65.9 | 85.1 | 579 | 4 |

-continued

| No. | Cg | T1 | T2 | T3 | Respective determination (kg/t) | % FPAR | % FPR | CSF (ml) | Frm Ind. |
|---|---|---|---|---|---|---|---|---|---|
| 27 | | AP1 | BI | X3 | 0.2/2/0.2 | 57.2 | 82.0 | 524 | 2 |
| 28 | | AP1 | BI | M100 | 0.2/2/0.2 | 66.3 | 85.4 | 587 | 3 |
| 29* | | AP1 | AD1 | BI | 0.2/0.2/2 | 78.9 | 89.7 | 621 | 2 |
| 30* | | AP1 | NP780 | AD1 | 0.2/0.45/0.2 | 72.5 | 87.9 | 598 | 2 |
| 31* | | AP1 | AD1 | NP780 | 0.2/0.2/0.45 | 76.6 | 88.6 | 613 | 2 |
| 32* | | AP1 | M100 | AD1 | 0.2/0.15/0.15 | 61.2 | 83.2 | 522 | 2 |
| 33* | | AP1 | AD1 | M100 | 0.2/0.15/0.15 | 65.6 | 84.9 | 559 | 2 |
| 34* | PAC | AP1 | AD1 | BI | 0.4/0.2/0.2/2 | 84.2 | 91.2 | 651 | 2 |
| 35* | PAC | AP1 | AD1 | NP780 | 0.4/0.2/0.2/0.45 | 80.2 | 90.3 | 631 | 2 |
| 36* | PAC | AP1 | AD1 | M100 | 0.4/0.2/0.15/0.15 | 72.3 | 88.3 | 622 | 2 |
| 37* | PAC | M100 | AP1 | AD1 | 0.4/0.15/0.2/0.15 | 71.8 | 87.5 | 615 | 2 |
| 38* | PAC | M100 | NP780 | AP/AD | 0.4/0.15/0.45/0.2 | 70.9 | 86.7 | 605 | 2 |

The test numbers comprising an * correspond to the various retention systems covered by the invention.

Conclusions and Commercial Advantages

The advantages which derive from the present invention are particularly excellent and unexpected and are applicable to all systems making use of a cationic retention-drainage polymer.

Thus the comparison of the various tests in the previous table serves to draw the following conclusions:

A) Counterexamples: Tests 1 to 3 and 4 to 6:

According to the knowledge of a person skilled in the art, and particularly patent EP 1086276, it is found that the use of the dual retention agent (that is the crosslinked cationic (co) polymer prepared without high shear according to the invention) as a single cationic retention agent in combination with an inorganic microparticle, provides significantly poorer retention drainage performance than a sheared crosslinked or linear polymer. Hence there was no reason to believe that the dual retention agent of the invention could, in combination with a main cationic agent and in lower proportions, be effective.

B) Retention and Drainage Systems of the Conventional Cationic Type:

Tests 0/7/12

These three examples show that the method of the invention (test No. 7) serves not only to substantially improve the retention of the fillers (from 51.9% to 67.9%) and the overall retention (from 80.6% to 85.6%), but also the drainage (from 442 ml to 516 ml), without harming the formation.

In fact, since this drainage is higher, a person skilled in the art could have expected a poorer formation. On the contrary, we find an improvement thereof.

INDUSTRIAL ADVANTAGES associated with the methods of the invention: at equivalent concentrations, improved performance.

Tests 0/18

The use of the main retention agent and the dual retention agent in the mixture serves to obtain an improvement in terms of overall retention performance by more than 3 percentage points (compared with test No. 0) and thus, and above all, a gain of 9 percentage points for retention of fillers and also much better drainage.

INDUSTRIAL ADVANTAGES associated with the methods of the invention: use of a single commercial product in the form of a mixture (i.e. a single preparation unit and a single injection unit) with improved performance for the machine (particularly concerning the machine speed).

Tests 17/18/19

A separate addition of the mixture of the invention shows a slight improvement compared with a single addition point, but here with a preservation of the quality of formation of the sheet.

Tests 7/17-19

The separate addition (test No. 7) systematically offers better performance than the simultaneous addition of the two products in the mixture.

Tests 1/17-19

The mixture of main and dual retention agents according to the invention proves to be highly competitive in terms of performance and in terms of cost compared with a conventional retention system of the Hydrocol type.

INDUSTRIAL ADVANTAGES associated with the products of the invention: in addition to improved retention drainage performance, it serves to avoid the well known difficulties associated with the use of bentonite. In fact, the use of bentonite is a burden for the paper manufacturer and often demands a large investment in the bentonite slurry preparation unit, which requires technical support and constant attention. Among the drawbacks connected with the use of bentonite, mention can be made of: malfunction of the proportioning screw (poor batching of powder during the preparation) because of problems of caking (free flowing) due to the high ambient humidity around the paper machine, replacement of big bags or loading with bags with potential risk to the operators due to the powderiness of the powder. Until the invention, at constant cost, no purely organic retention and drainage system made it possible to eliminate the use of bentonite.

C) Dual Retention and Drainage Systems:

C1) Hydrocol Retention System (Cationic Polymer+Bentonite):

Tests 1/7

The comparison of these two tests shows, unexpectedly, that the use of a cationic/crosslinked cationic retention system according to the invention serves to develop superior performance to a retention system using bentonite (Hydrocol type).

Tests 1/21/29/34

Test 1 represents the usual setting for the use of a retention system with bentonite (Hydrocol type). Tests 21, 29 and 34 are alternatives of the invention which show very significant improvements in performance.

| Test | % FPAR | % FPR | CSF (ml) | Frm Ind |
|---|---|---|---|---|
| 1 | 63.4 | 83.1 | 499 | 3 |
| 21 | 74.3 | 88.6 | 610 | 2 |
| 29 | 78.9 | 89.7 | 621 | 2 |
| 34 | 84.2 | 91.2 | 651 | 2 |

Tests 21/29

These tests show that the inversion of the addition point of the crosslinked cationic (co)polymer with the tertiary retention agent does not offer any particular advantage. On the contrary, the introduction of the crosslinked polymer at the usual bentonite injection point yields better results in terms of retention drainage performance. By contrast, it should be observed that the contribution of the crosslinked cationic (co)polymer in flocculation does not require any particular shear before the addition of bentonite, and that moreover, this does not have a negative effect on the formation.

C2) Composil Retention System (Cationic Polymer+Silica):

Tests 4/7

It may be observed that the cationic (co)polymer/crosslinked cationic (co)polymer retention system of the invention (test No. 7) can be substituted for the conventionally used cationic polymer/silica system (test No. 4), while providing better performance in terms of retention and drainage.

Tests 4/30/31/35

These tests show that the use of the polymers and the sequences according to the invention are substantially superior to the silica based systems conventionally used in papermaking.

Tests 1/4/31/35

A rapid comparison of the retention systems called conventional using either bentonite or silica (tests 1/4) confirm the observations of the industry, that is, that systems with bentonite are more appropriate to faster machines, compared with systems with silica which, in this particular case, display more limited performance.

The cationic (co)polymers and their injection points presented by the invention serve to raise the performance level of a silica type system to a level substantially superior to that of a Hydrocol type bentonite system, in terms of overall retention, fillers, as well as drainage.

INDUSTRIAL ADVANTAGES associated with the methods of the invention: besides the gain in overall performance, possibility for the paper manufacturer to use silica with extremely simple equipment (pump) on high speed machines, instead of the large scale equipment necessary for the use of bentonite.

C3) Cationic Polymer+Anionic Polymer Type Retention System:

Tests 7 to 16

These comparative tests show that the use of a crosslinked cationic (co)polymer as described in the invention, in combination with a main retention agent which is also cationic, surpasses all the other systems in terms of performance, retention and drainage. In particular, they significantly surpass a cationic (co)polymer/anionic polymer system of the Polyflex type (test 14), well known and marketed by Ciba.

D) Three-Component Retention and Drainage Systems:

The conventional systems called tricomponent systems are based on the use of a dual system generally based on a cationic (co)polymer and an inorganic particle supplemented by the addition of an anionic (co)polymer. An example commercially developed by Ciba is the Telioform system (corresponding to test 28). This type of system is particularly recommended when the paper manufacturer seeks high filler retention.

Tests 21 to 28

In these tests, the inorganic particle used is bentonite, but this choice is not at all restrictive.

A comparison of these tests shows unexpectedly that the substitution of the anionic (co)polymer (Telioform M100) by the crosslinked cationic (co)polymers of the invention serves to obtain substantially superior performance and especially on the criterion of filler retention, which improves from 66.3% to 74.3%.

Tests 37 and 38

The inversion of addition sequence of retention agent, i.e. the one or the tertiary anionic agents are introduced before the main agent, and the dual agent does not disturb the performances of the instant invention.

INDUSTRIAL ADVANTAGES associated with the methods of the invention: all the abovementioned advantages associated with productivity, profitability and runability are obviously preserved. Moreover, the very substantial improvements obtained in filler retention will enable the paper manufacturer to substitute a portion of his fibers (the most noble and most expensive materials in the composition of the paper) by mineral fillers (very inexpensive). The results developed by the invention in a three-component system in fact offers the paper manufacturer the possibility of drastically cutting the production cost of the paper, while improving its optical properties, and also its printability properties (these parameters being major factors, particularly for the text printing industry).

E) Impact of the Addition Sequence on the Performance of the Cationic Polymers of the Invention:

Tests 21/29 to 33

As stated in the specification of the invention, it is observed that to obtain very high retention and drainage performance as well as good sheet formation, it is preferable to use a sequence in which the dual retention agent is introduced between the main retention agent and the retention agent called tertiary.

G) Impact of the Use of a Coagulant:

Tests 29/31/33 to 36

Here, the coagulant used is PAC, but this choice is not at all restrictive.

A person skilled in the art will understand that thanks to the use of a coagulant, a novel improvement is observed in all the retention, filler retention and drainage performance. However, it is interesting to observe that the values found in these final tests are particularly high, and so far unequalled by the pre-existing retention and drainage systems.

CONCLUSION

The advantages deriving from the present invention (that is a method for the production of paper, cardboard or similar materials, using at least two retention and drainage agents, each organic and having an overall cationic charge, and whereof one is crosslinked) are equally remarkable and unexpected and are applicable to all systems involving a cationic retention-drainage polymer.

As demonstrated above, the well-known and widely marketed retention systems such as Hydrocol (test 1), Composil (test 4) and Polyflex (test 14) are significantly surpassed by the invention (in particular tests 7 and 10).

The advantages of the improvements observed (in terms of retention and drainage) deriving from the invention will have a direct impact on the paper machine and hence for the paper manufacturer, that is:

better productivity due in particular to higher speed of the machine, better cleaning of the water in the short circuit (white water), less machine breakage, lower dryness in the press and hence savings in steam power in the dryer section.

The preservation, and even improvement, of the sheet formation, enhances the quality of the paper produced.

The invention claimed is:

1. A method for producing paper, cardboard or similar materials, which comprises, separately or in a mixture, adding to a fibrous suspension:

at least one main retention agent comprising a cationic (co)polymer, and at least one dual retention agent comprising, a crosslinked cationic (co)polymer obtained in the form of a water-in-water type emulsion or standard reverse emulsion other than microemulsion, and placed in solution with gentle stirring prior to its introduction into the fibrous suspension, said crosslinked cationic (co)polymer having a UL viscosity of between 1.3 and 2.7 cps, and an apparent cationicity ratio of between 25 and 75%, and, optionally, before or after the dual agent or the main retention agent, one or more tertiary retention agent(s) selected from the group consisting of mineral particles and organic polymers carrying anionic charges, wherein the at least one main retention agent and the at least one dual retention agent have an overall cationic charge.

2. The method as claimed in claim 1, wherein the dual retention agent is placed in solution with stirring between 50 and 500 rpm.

3. The method as claimed in claim 1, wherein the dual retention agent is obtained by polymerization or copolymerization, in standard reverse emulsion other than microemulsion, of at least one cationic monomer and, optionally, nonionic monomers, in the presence of at least one crosslinking agent.

4. The method as claimed in claim 3, wherein:

a) the cationic monomers are selected from the group consisting of dimethylaminoethyl acrylate (ADAME) and/or dimethylaminoethyl methacrylate (MADAME) quaternized or salified, dimethyldiallylammonium chloride (DADMAC), acrylamidopropyltrimethylammonium chloride (APTAC) and/or methacrylamidopropyltrimethylammonium chloride (MAPTAC);

b) the nonionic monomers are selected from the group consisting of acrylamide, methacrylamide, N-isopropylacrylamide, N—N dimethylacrylamide, N-vinylformamide, N-vinyl acetamide, N-vinyl pyrrolidone, vinylacetate, acrylate esters, allyl alcohol and/or unsaturated anionic ethylenic monomers having a carboxylic function (e.g. acrylic acid, methacrylic acid, and salts thereof, etc.), having a sulfonic acid function (e.g. 2-acrylamido-2-methylpropane sulfonic acid (AMPS), methallyl sulfonic acid and salts thereof, etc.); and c) the crosslinking agent is selected from the group consisting of methylene bisacrylamide (MBA), ethylene glycol diacrylate, polyethylene glycol dimethacrylate, diacrylamide, cyanomethylacrylate, vinyloxyethylacrylate or methacrylate, triallylamine, formaldehyde, glyoxal, compounds of the glycidylether type such as ethyleneglycol diglycidylether, or epoxy resins and derivatives thereof.

5. The method as claimed in claim 1, wherein the dual retention agent is introduced into the suspension at the rate of 30 g/t to 1000 g/t by weight of active material (crosslinked cationic (co)polymer) of the dry weight of the fibrous suspension.

6. The method as claimed in claim 1, wherein the main retention agent comprises a cationic (co)polymer:

of at least one nonionic monomer selected from the group consisting of acrylamide, methacrylamide, one of their substituted derivatives, N-vinylformamide, N-vinyl acetamide, and N-vinylpyrrolidone.

7. The method as claimed in claim 1, wherein the main retention agent is a cationic (co)polymer obtained:

by Hofmann degradation or Hofmann reaction on acrylamide based (co)polymers, by hydrolysis reaction on a (co)polymer of N-vinylformamide and/or N-vinyl acetamide, or by Mannich reaction on acrylamide based polymers.

8. The method as claimed in claim 1, wherein the quantity of main retention agent introduced into the suspension to be flocculated is between thirty and one thousand grams of active polymer per tonne of dried pulp (30 and 1000 g/t).

9. The method as claimed in claim 1, wherein the main retention agent and the dual retention agent form a mixture.

10. The method as claimed in claim 1, wherein the dual retention agent is introduced after a pressure screen.

11. The method as claimed in claim 1, wherein the mineral particles are selected from the group consisting of bentonites, hectorites, smectites, montmorillonites, nontronites, saponites, sauconites, hormites, attapulgites sepiolites, silicates, silicoaluminates borosilicates, zeolites, kaolinites, colloidal silicas and precipitated silica.

12. The method as claimed in claim 1, wherein, with or without tertiary agent, a coagulant is added to the fibrous suspension prior to the addition of the main retention agent, said coagulant being selected from the group consisting of inorganic coagulants and organic coagulants.

13. The method as claimed in claim 1, wherein the dual retention agent has a cationicity lower than 4 meq/g.

14. The method as claimed in claim 1, wherein the main retention agent is a cationic polymer of natural origin, selected from the group consisting of derivatives of starch or of guar gum.

15. The method as claimed in claim 1, wherein said UL viscosity is between 1.5 and 2.4 cps.

16. The method as claimed in claim 2, wherein said stirring is between 70 and 200 rpm.

17. The method as claimed in claim 5, wherein said rate is 150 g/t to 500 g/t by weight of active material (crosslinked cationic (co)polymer) of the dry weight of the fibrous suspension.

18. The method as claimed in claim 6, wherein the main retention agent further comprises at least one unsaturated cationic ethylenic monomer, selected from the group consisting of the monomers of the type of dialkylaminoalkyl (meth) acrylate, dialkylaminoalkyl (meth)acrylamide, diallylamine, methyldiallylamine and their quaternary ammonium or acidic salts.

19. The method according to claim 12 wherein said organic coagulant is chosen from the group consisting of (a) polymers based on diallyldimethyl ammonium chloride (DADMAC), (b) polyethyleneimine, (c) quaternary polyamines produced by condensation of a primary or secondary amine with epichlorhydrin, (d) vinylamine polymers and (e) dicyandiamide resins.

* * * * *